US005931534A

United States Patent [19]

Hutter

[11] Patent Number: 5,931,534

[45] Date of Patent: Aug. 3, 1999

[54] CHILD PACIFICATION DEVICE

[76] Inventor: Edward F. Hutter, 609 Mountainview Dr., Wayne, Pa. 19482

[21] Appl. No.: 08/643,968

[22] Filed: May 7, 1996

[51] Int. Cl.[6] ..... A47C 1/00; A47C 3/00

[52] U.S. Cl. ..... 297/344.23; 297/344.26; 297/217.3

[58] Field of Search ..... 297/344.21, 344.23, 297/344.26; 248/349.1, 415; 5/94, 107, 108, 109; 897/263.1, 263.2, 217.3

[56] References Cited

U.S. PATENT DOCUMENTS

| | | | |
|---|---|---|---|
| 2,671,631 | 3/1954 | Fox | 297/344.26 X |
| 2,876,051 | 3/1959 | Fox | 248/349.1 |
| 3,191,594 | 6/1965 | Bagnell | 297/344.23 |
| 4,600,239 | 7/1986 | Gerstein et al. | 297/344.23 X |
| 4,762,364 | 8/1988 | Young | 297/344.26 X |
| 4,969,685 | 11/1990 | Chihaya et al. | 297/344.23 X |
| 5,092,004 | 3/1992 | Cone et al. | 5/94 X |
| 5,228,155 | 7/1993 | Shultz et al. | 5/109 |
| 5,489,142 | 2/1996 | Mathieu | 297/344.26 X |

*Primary Examiner*—Milton Nelson, Jr.
*Assistant Examiner*—Anthony D. Barfield
*Attorney, Agent, or Firm*—John F.A. Earley; John F.A. Earley III; Harding, Earley, Follmer & Frailey

[57] ABSTRACT

A dual-purpose powered rotating infant pacification device and method comprises a carrier for supporting an infant, the carrier constructed and arranged to safely contain the infant and to support an adult, a carrier frame supporting the carrier, a base supporting the carrier frame, connecting member rotatably connecting the carrier frame to the base, a drive member mounted on the base for rotating the carrier and transmission member for connecting the drive member and the carrier, the device being constructed and arranged to safely contain and continuously rotate the infant when the drive member is electrically engaged to provide a pacifying effect on the infant, and the device being constructed and arranged to safely support an adult and to have the carrier free to rotate manually when the drive member is electrically disengaged. A method of pacifying an infant by providing a continuously rotating carrier.

16 Claims, 7 Drawing Sheets

CHILD PACIFICATION DEVICE

FIELD OF THE INVENTION

The present invention relates to a dual purpose infant pacification device/adult comfort chair. More particularly, the invention relates to an electrically-powered, continuously rotating carrier constructed to safely contain and pacify an infant and also constructed to comfortably support an adult.

BACKGROUND OF THE INVENTION

For most parents and other child care providers, child pacification devices are a necessity. For convenience, most parents and child care providers set up and store such pacification devices in the household family room or living room which typically also contain adult-size comfort furniture. The combination of such child pacification devices and adult size comfort furniture causes overcrowding and an unkept appearance in the room. It would be desirable to provide a single device which is designed to safely contain and pacify an infant and also designed to comfortably support an adult.

Wind-up swings, walkers, rockers, and jumpers are a few devices known in the prior art for pacifying infants. The reciprocating action of such devices provides gentle motion and a continuous change of scenery, both of which generally sooth and pacify an infant. However, none of the above-listed child pacification devices can serve as furniture to comfortably support an adult.

While an electrically powered rotating seat capable of supporting an adult is described in Chihaya et al. U.S. Pat. No. 4,969,685, the rotatable seat described by Chihaya is not designed to safely contain an infant or to provide continuous rotation, or to accept infant accessories as required by a child pacification device. Further, the chair described in Chihaya must be mounted to the floor and requires extensive gearing to be built-in to the rotating members. This gearing arrangement is expensive to construct.

SUMMARY OF THE INVENTION

It is an object of the present invention to provide a dual-purpose powered rotating infant pacification device which may also be used as adult comfort furniture when not being used as a child pacification device.

It is a further object of the present invention to provide a dual-purpose powered rotating infant pacification device having a carrier which is adapted to accept infant accessories.

It is an additional object of the present invention to provide a dual-purpose powered rotating infant pacification device having a simplified rotating mechanism which is designed for continuous rotation.

These and other objects are accomplished by providing an inventive dual-purpose powered rotating infant pacification device which may safely contain and continuously rotate an infant to provide a pacifying effect on the infant when the device is being used as an infant pacification device, and which may safely support an adult and be freely rotated manually when the device is being used as adult comfort furniture.

The dual-purpose device of the present invention comprises a carrier for supporting an infant or an adult, depending on its use. The carrier preferably comprises an adult size comfort chair having a horizontal cushion surrounded at least partially by cushioned side walls and also preferably includes a safety harness for securing the infant on the chair.

The carrier has a carrier frame supporting the carrier on a base. The carrier frame comprises a carrier plate having a circular disc-shaped center aperture with an annular shoulder and an annular groove radially located intermediate the annular shoulder and the outer perimeter of the carrier plate. The carrier also includes flange portions extending upwardly from the outer perimeter of the carrier plate, and means for securing the flange portions to the carrier to secure the carrier to the carrier frame. The annular shoulder has opposed square cut-outs in the annular shoulder contiguous with the circular disc-shaped center aperture along a common diameter of said aperture.

A base supports the carrier frame and comprises a circular base plate having a center aperture with an annular shoulder and an annular groove radially located intermediate the annular shoulder and the circumference of the base plate. The base plate further includes a plurality of legs fixed to and extending radially from the base plate. The legs are arched to elevate the base plate over the surface of the floor a distance sufficient to mount a drive means underneath the base plate. Variations of leg designs would also include grid shaped vertical supports shaped in a tic-tac-toe fashion and pentagonal shaped vertical supports connecting the ends of the radial legs together.

Connecting means rotatably connect the carrier frame to the base. The connecting means comprises a swivel bolt arrangement including a drive bolt having a threaded end and a hex-shaped socket formed in the head of the drive bolt. The drive bolt has its threaded end fixed to the carrier frame and its head end rotatably connected to the base. The drive bolt includes a drive pin extending through the shank of the drive bolt transverse to the lengthwise axis of the drive bolt.

A drive means, mounted to the base, is provided for rotating the carrier. The drive means preferably comprises low-speed, high-torque, electric motor sized to spin the carrier supporting one or two children, but which may be stalled by manually holding the carrier frame to prevent it from turning.

A gearless, direct drive transmission connects the motor to the carrier via the carrier frame. The transmission comprises a motor output shaft with a hex-shaped end portion inserted in and connected to the hex-shaped socket of the drive bolt.

The dual purpose device of the present invention may also include in combination one of several commercially available infant accessories mounted on and secured to the carrier. Such accessories include a bassinet, a subseat, a food tray, or a mobile. The carrier may also include a vibrator located underneath the horizontal cushion and a music box mounted on the base for providing further pacifying effect on the infant.

The electric motor is preferably sized to have only enough torque to spin an infant in the carrier. However, the electric motor may be sized with enough torque to spin an infant and an adult in the carrier or just the adult if so desired.

DETAILED DESCRIPTION OF A PREFERRED EMBODIMENT

For the purpose of illustration, preferred embodiments of the claimed invention are shown in FIGS. 1–19 wherein like numerals are used to designate like parts throughout the drawings.

Figure 1:
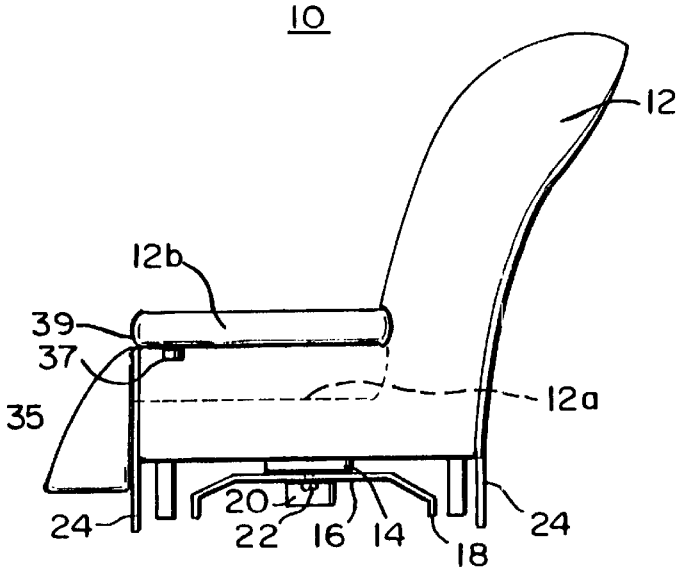
FIG. 1 is a side view of a first embodiment of the device constructed in accordance with the invention.
Figure 2:
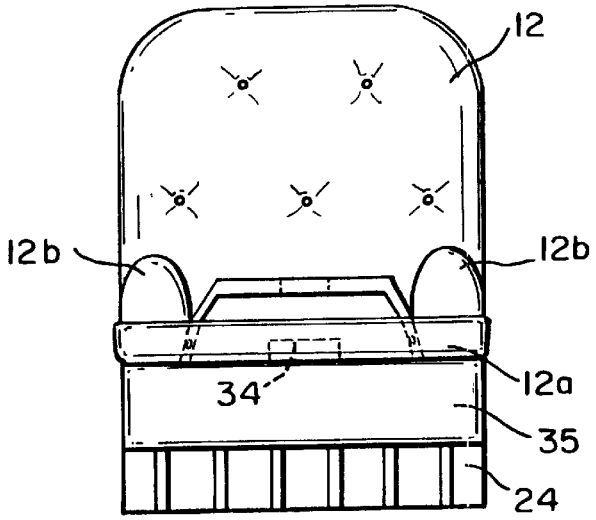
FIG. 2 is a front view of the embodiment of the invention shown in FIG. 1.

Referring to FIGS. 1 and 2, an embodiment of the dual-purpose powered rotating infant pacification device 10 comprises a carrier 12 fixed to a carrier frame 14 which supports the carrier 12 on a base 18. The carrier frame 14 is rotatably connected by connecting means 16 to the base 18 which is constructed to rest on a flat surface such as a living room floor. The device 10 further includes drive means 20, such as an electric motor, mounted on the base 18 and connected to the carrier frame 14 by a transmission 22, for continuously rotating the carrier 12.

In the embodiment illustrated in FIGS. 1 and 2, the carrier 12 comprises a modification of the seat of a contemporary comfort chair such as would typically be found in a living room or family room. The device can also be used to convert existing chairs. Such a chair may be selected from a large number of commercially available comfort chairs including, for example, chairs sold by Ethan Allen Inc. and illustrated on page 154 of the Ethan Allen catalogue entitled "The Treasury of American Home Interiors—95th Edition" including swivel, rocker, recliner, and all standard 4-legged comfort chairs.

Preferably, the carrier 12 of the device 10 includes a horizontal cushion 12*a* surrounded at least partially by cushioned side walls 12*b*. In the embodiment illustrated in FIGS. 1 and 2, the opposed arm rests and the back of the carrier 12 act as side walls for the horizontal cushioned seat. The carrier 12 is also preferably provided with a skirt 24 which extends around the perimeter of the bottom of the device 10 to conceal the carrier frame 14, connecting means 16, base 18 and drive means 20.

Figure 2A:
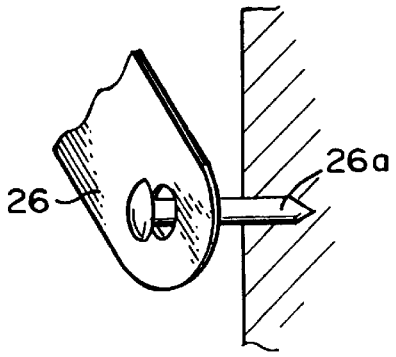
FIG. 2*a* is an enlarged perspective view of means for fastening a safety harness to the carrier shown in FIG. 2.
Figure 3:
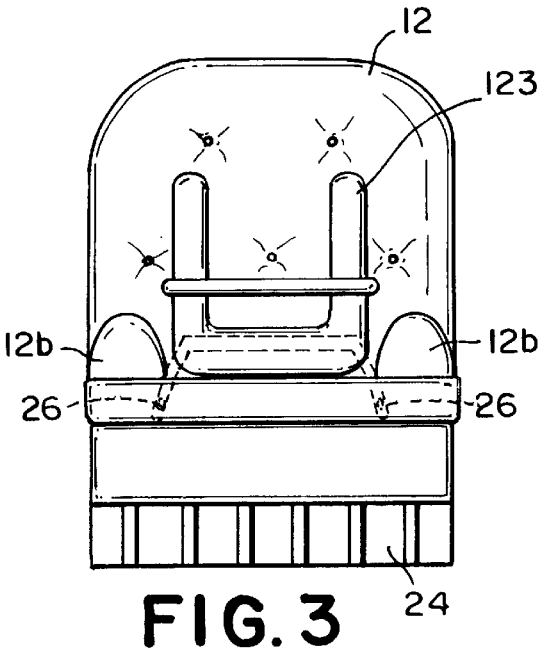
FIG. 3 is a front view of a second embodiment of the invention.
Figure 4:
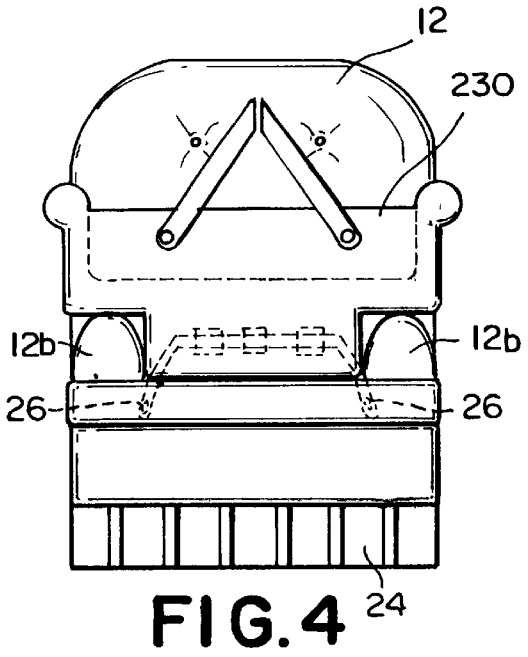
FIG. 4 is a front view of a third embodiment of the invention.
Figure 5:
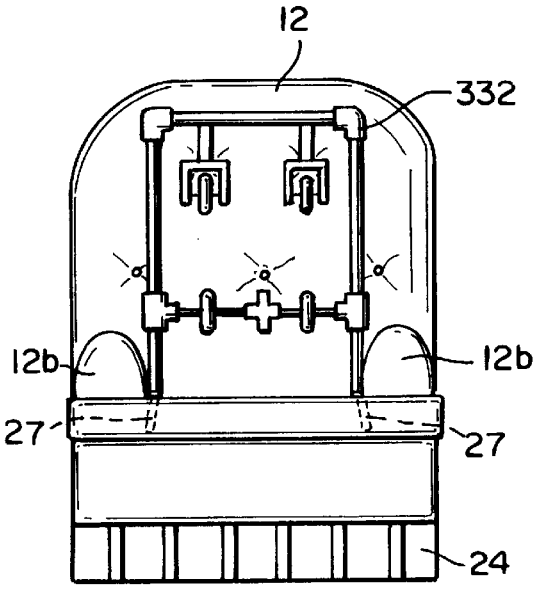
FIG. 5 is a front view of a fourth embodiment of the invention.

The carrier 12 preferably includes a safety harness 26 for securing the infant on said carrier. The safety harness is attached to the carrier by fasteners 26*a* such as screws or staples which pierce and anchor the end of the harness to the frame of the carrier as seen in FIG. 2*a*. Alternatively, the safety harness can be used to secure other infant devices to the carrier such as a subseat 128 having a food tray as illustrated in FIG. 3 or a bassinet 230 as illustrated in FIG. 4. The carrier may also be provided with additional straps with snaps 27 for securing other infant devices to the carrier such as a toy entertainment accessory or mobile 332 as illustrated in FIG. 5. When not in use, the safety harness 26 and the straps with snaps 27 may be concealed by tucking the harness 26 and straps 27 into the crevice between the horizontal cushion 12*a* and the side arms 12*b*.

The carrier 12 may also include a vibrator 34 for providing a further pacifying effect on the infant as seen in FIG. 2. Preferably, the vibrator 34 is positioned underneath the horizontal cushion 12*a* and is controlled by a switch located underneath the horizontal cushion 12*a* or underneath the carrier 12. The vibrator 34 is powered preferably by DC cells also located underneath the horizontal cushion 12*a* or underneath the carrier 12 which are connected to the vibrator 34 by appropriate wiring.

Figure 1A:
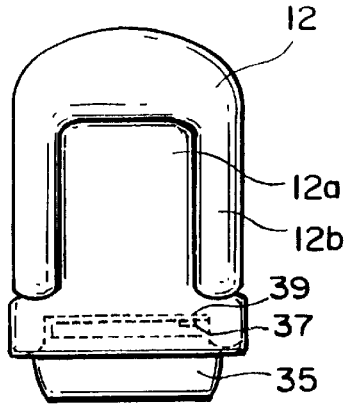
FIG. 1*a* is a top view of the device shown in FIG. 1.

The carrier 12 may also include a removable foot cushion extension 35 as seen in FIG. 1. The foot extension 35 is used by an adult in the carrier for added comfort and to suspend the adult's feet above ground when the carrier is rotating. The foot cushion 35 is attached using removable fastening tabs 37, such as Velcro®, opposed pieces of which are sewn to the carrier 12 under horizontal cushion 12*a* and to an attachment flap 39 on the foot cushion 35 as seen in FIG. 1*a*.

The carrier 12 is designed to safely contain and continuously rotate the infant when the drive means is electrically engaged to provide a pacifying effect on the infant. The carrier's rotational motion and change of scenery resultant therefrom safely and continuously entertain and pacify the infant.

The carrier 12 is also designed to safely support an adult and to be freely rotated manually when the motor is electrically disengaged. Thus, when the dual-purpose device 10 is not being used to pacify an infant, the dual-purpose device 10 may be used as adult-comfort furniture for the living room or family room. The device's dual capacity presents a solution to a room-clutter problem by obviating the need for pacifying devices which are capable of only accommodating infants.

Figure 7:
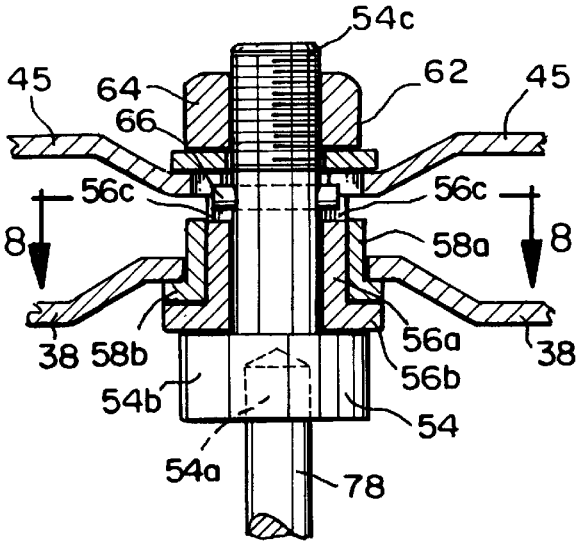
FIG. 7 is an enlarged, cross-sectional view of the connecting means of an embodiment of the invention shown in FIG. 6.
Figure 6:
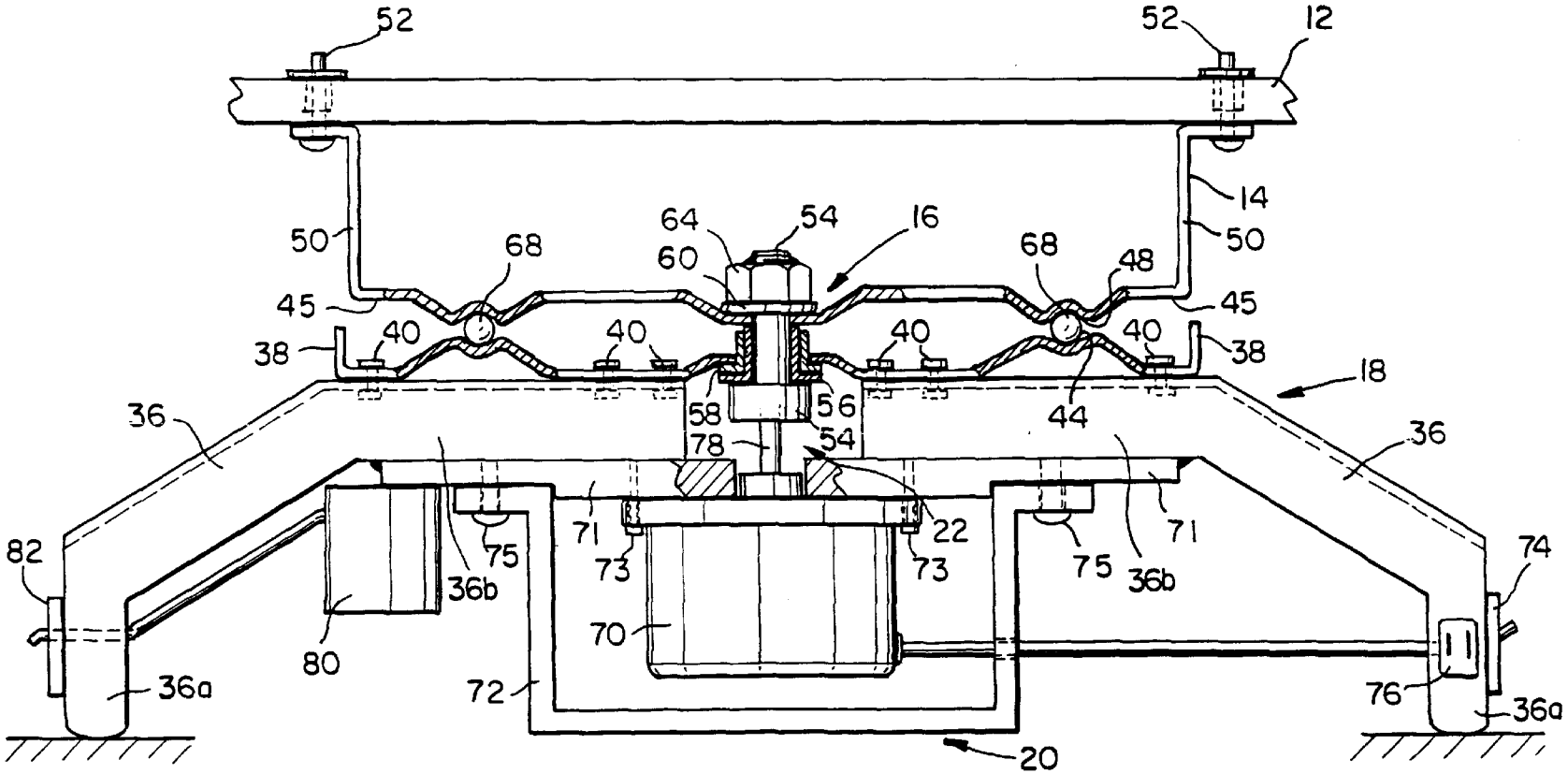
FIG. 6 is a side elevation partially in cross-section of the carrier frame, connecting means, drive means and base of an embodiment of the invention.
Figure 8:
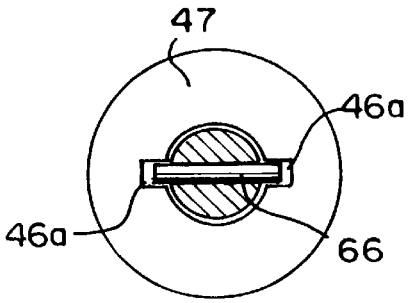
FIG. 8 is an enlarged sectional view taken along lines 8—8 of FIG. 7 showing the drive pin engagement.

The carrier frame 14, connecting means 16, base 18, drive means 20 and transmission 22 are shown in greater detail in FIGS. 6–8.

Figure 9:
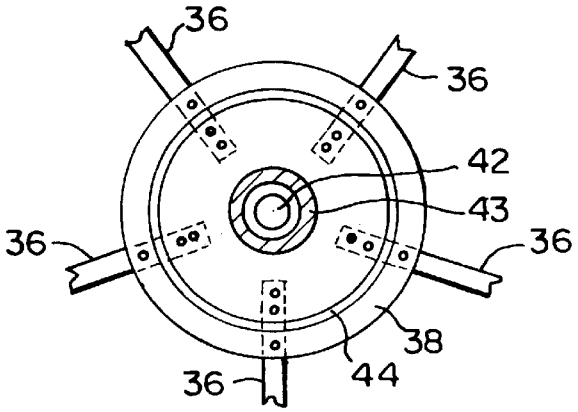
FIG. 9 is a top plan view of the base of an embodiment of the present invention.

Referring to FIGS. 6 and 9, the base 18 comprises a plurality of legs 36 fixed to and extending radially from a circular base plate 38. The legs 36 are fastened to the base plate by fasteners 40 such as rivets, screws or bolts which extend through the lengthwise attachment section 36*b* of each leg 36 and through the base plate 38. Preferably the base 38 comprises 3–6 legs, more preferably 4–5 legs. Alternatives to the radial leg design are described below with reference to FIGS. 13–17.

The legs 36 are arched to elevate the base plate 38 over a flat surface a distance sufficient to mount the drive means 20 underneath the base plate 38. Preferably the feet 36*a* of the legs 36 extend transverse to base plate 38 and to the plane formed by the lengthwise attachment sections 36*b* of the legs 36.

Referring to FIGS. 6 and 9, the base plate 38 comprises a contoured metallic circular disc having a center aperture 42 with an annular shoulder 43 and an annular groove 44 radially located intermediate the annular shoulder 43 and the outer circumference of the base plate 38. Referring to FIG. 6, the annular groove 44 in the base plate 38 cooperates with an annular groove 48 in the carrier frame 14 to form a race in which ball bearings 68 are contained and may freely rotate.

Figure 10:
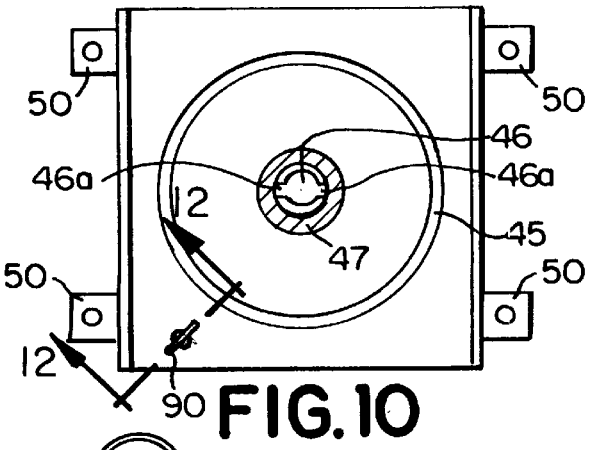
FIG. 10 is a top plan view of the carrier plate of the carrier frame of an embodiment of the present invention.

Referring to FIGS. 6 and 10, the carrier frame 14 comprises a square or rectangular-shaped plate 45 having a center aperture 46, an annular shoulder 47 and an annular groove 48 radially located intermediate the annular shoulder 47 and the outer perimeter of the plate 45. The annular groove 48 is equal to and opposed from the annular groove 44 in the base plate. The center aperture 46 comprises a circular disc-shaped aperture. The annular shoulder 47 has opposed notches or cut-outs 46*a* in the shoulder 47 contiguous with said circular disc-shaped center aperture along a common diameter of the disc-shaped aperture. The carrier plate 45 further includes flanges 50 which extend upwardly from the outer perimeter of the carrier plate 45 and fasteners 52 such as roundhead screws with threaded inserts for securing the carrier 12 to the carrier frame 14.

Referring to FIGS. 6 and 7, the carrier frame 14 and the base 18 are connected by connecting means 16. The connecting means comprises a swivel bolt arrangement rotatably connecting the base plate 38 and the carrier plate 45.

Referring to FIG. 7, the swivel bolt arrangement comprises a drive bolt 54 having a hex-shaped socket 54*a* in the head of the bolt. The drive bolt 54 extends through the center apertures of both the carrier plate 45 and the base plate 38. A sleeve bearing 56 with a flanged end 56*b* is located on the shank at the threadless end 54*b* of the drive bolt 54 and arranged such that the outer surface of the flanged end abuts the drive bolt head. An insert bushing 58 is located over the sleeved portion 56*a* of the sleeve bearing 56. The outer surface of the sleeve portion 58*a* of the insert bushing 58 is located through the center aperture of the base plate 38 with a tight fit so as to remain fixed to the base plate 38. The insert bushing has a flanged end 58*b*. The outer surface of the flanged end 58*b* of the insert bushing 58 abuts the inner surface of the flanged end 56*b* of the sleeve bearing 56. The inner surface of the flanged end 58*b* of the insert bushing 58 abuts the annular shoulder 43 of the base plate 38 thereby preventing the insert bushing 58, sleeve bearing 56, and drive bolt from passing through the center aperture 42 in the base plate 38. The sleeved portion 56*a* of the sleeve bearing 56 is slightly longer than the sleeve portion 58*a* of the insert bushing 58 and protrudes through the sleeved portion 58*a* of the insert bushing 58 and abuts the annular shoulder on the underside of the carrier plate 45 thereby preventing the carrier plate 45 and the sleeved portion 58*a* of the insert bushing 58 or the base plate 58 from contacting one another when the swivel bolt arrangement is fully tightened.

The threaded end 54*c* of the shank of the bolt 54 extends through the center aperture in the carrier plate 45. A flat washer 60 is located over the threaded end 54*c* of the drive bolt 54 and abuts the annular shoulder 47 of the center aperture on the upper side of the carrier plate 45. A lock nut 64 is located over the threaded end 54*c* of the drive bolt 54 to tighten and complete the swivel arrangement.

The radial clearance between the insert bushing 58, and the flanged sleeve bearing 56, in conjunction with the axial clearance between the flanged ends of the sleeve bearing 56 and insert bushing 58, allow the drive bolt assembly to rotate freely. The drive bolt assembly also prevents the base plate 38 and the carrier plate 45 from separating when the chair is lifted off the ground.

In a preferred embodiment, a drive pin 66 is inserted through an aperture transverse to the diameter of the shank of the drive bolt 54 at a location contiguous with the annular shoulder 47 and aperture 46 in the carrier plate 45. Opposed ends of the drive pin extend into square slots 56*c* located in the end of the sleeved portion of the sleeve bearing 56. Opposed ends of the anti-rotation pin 66 also extend into square notches 46*a* in the carrier plate center aperture 46 simultaneously with the square slots 56*c* of the sleeved portion of the sleeve bearing 56, thereby preventing the drive bolt 54 from rotating independently of the carrier plate 45 and the sleeve bearing 56.

Thrust ball bearings 68 are located in the race formed between the annular grooves 44 and 48 in the base plate 38 and carrier plate 45, respectively. The ball bearings 68 support the weight of the carrier 12 and its occupant while allowing near-frictionless rotation of the carrier 12 relative to the base 18. The curvature of the annular grooves also allows the thrust bearing to support side loading.

A drive means 20 is mounted on the underside of the base 18 in the space provided by the arch of the legs 36. The drive means 20 preferably comprises a DC or AC powered gear motor 70 fixed to the underside of the legs 36 or base plate 38. For example, the motor 70 may be a REX ENGINEERING shaded pole, AC, low-speed, high-torque motor. The motor is preferably sized to spin the carrier supporting one or two infants, but not to spin if an adult is sitting in the carrier. Alternatively, the motor may also be sized to spin an adult in the carrier. The drive means preferably includes a motor mount 71 which is also fixed to the underside of the legs 36 or base plate 38. The motor mount 71 allows the motor 70 to be fastened to the motor mount 71 using fasteners 73. The drive means preferred includes a motor cover 72 which is fixed to the motor mount 71. The motor cover 72 protects the motor 70 from being damaged when the device 10 is being moved, limits access to the motor 70 by a child, and acts as a shield to prevent grease or oil from the motor 70 from falling onto the rug of the living room floor. The motor cover 72 is attached to motor mount 71 using fasteners 75. The motor 70 is connected to and controlled by a foot operated switch 74 preferably fixed to one of the legs 36 or otherwise freely accessible to the user but also concealed from normal sight. The base also includes a male electrical connector 76, also preferably fixed to one of the legs 36 near the foot operated switch 74, to which a power cord may be removably connected for powering the motor 70.

The motor 70 preferably has an output shaft 78 having a hex-shaped end which is inserted upward into the hex-shaped socket 54*a* in the drive bolt 54. This interconnection comprises a direct drive transmission which allows the motor 70 to drive the carrier via the drive bolt. Since the motor is not connected to the carrier 12 via any gear mechanism, the carrier can be freely rotated when the motor is disengaged or de-energized without damaging the motor or the transmission. Further, the carrier can be manually stalled/stopped, even when the motor is engaged or energized, without damaging the motor or the transmission.

The dual-purpose device 10 may also include a music box 80 mounted to the base 18 to provide music as the carrier spins. The music box 80 is preferably connected to and controlled by a second foot-operated switch 82 which is electrically connected to the male electrical connector 76.

Figure 11:
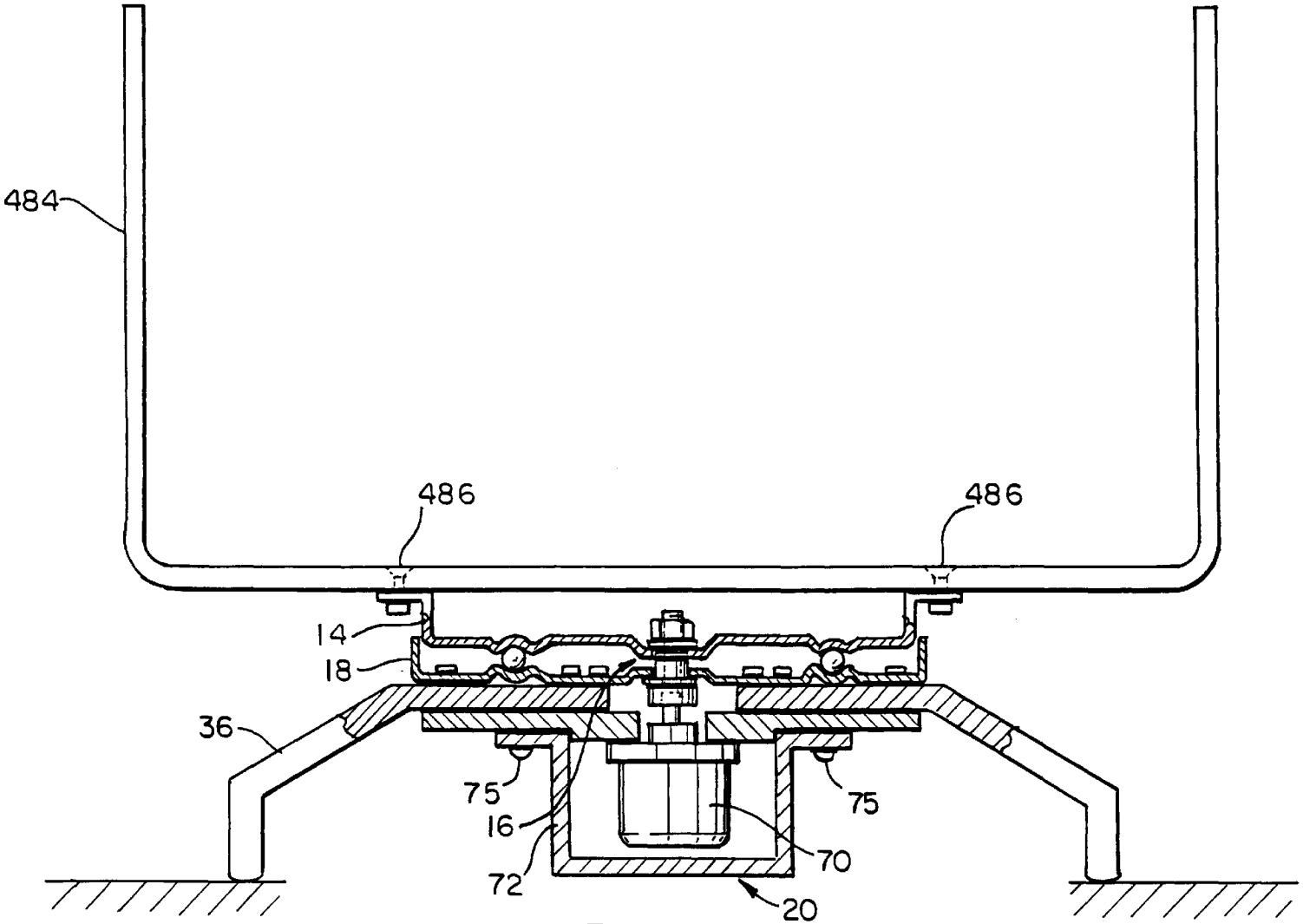
FIG. 11 is a view in cross-section of a fifth embodiment of the invention.

Referring to FIG. 11, the carrier 12 may be replaced by a playpen 484 which is mounted on and secured to the carrier frame 14 with fasteners 486 such as screws, bolts, or rivets. The playpen 484 may be substituted for the carrier 12 shown in FIG. 6 when desired by removing the fasteners 52 and the carrier 12 from the carrier frame 14, and attaching the playpen 484 to the carrier frame 14 with its own fasteners 486. In this embodiment, the playpen continuously rotates on the base 18 while allowing the infant to freely move about within the playpen 484.

Figure 12:
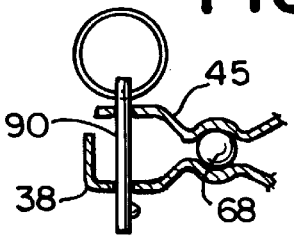
FIG. 12 is an enlarged sectional view taken along lines 12—12 showing optional anti-rotation pin for the carrier frame.

Referring to FIG. 10 and FIG. 12, an anti-rotation pin 90 can be inserted through circular apertures in carrier plate 45 and base plate 38 by rotating carrier plate 45 relative to base plate 38 until apertures in each are linearly contiguous with each other, whereby anti-rotation pin 90 can be inserted through the upper side of the carrier plate 45 down through an aperture in base plate 38. This feature allows the user the choice of making the entire device non-rotatable, thereby preventing inadvertent operation of the rotational features of this device.

Figure 13:
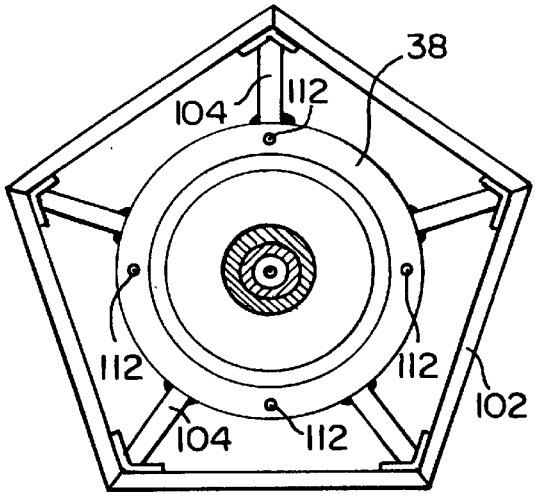
FIG. 13 is a top plan view of the pentagonal base hub leg design.
Figure 14:
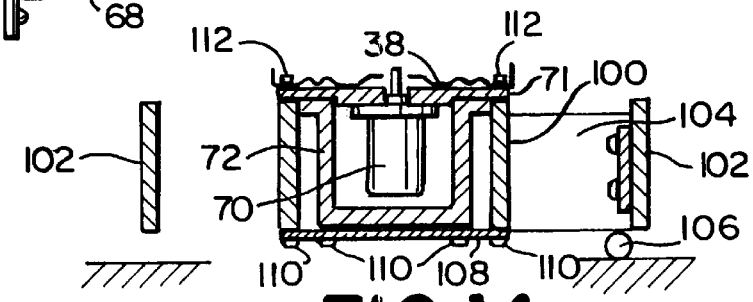
FIG. 14 is an enlarged section of a leg of FIG. 13 showing attachment of a pentagonal base to the motor housing.

In another embodiment shown in FIGS. 13 and 14, the base legs 36 along with its features can be alternatively replaced with a hub 100, perimeter structural members 102 and radially perimeter extending spokes 104 connecting the hub 100 to the perimeter structural members 102 as seen in FIGS. 13–14. The radially extending spokes 104 and perimeter members 102 are fastened together preferably to form a pentagonal shape. The hollow center of the hub 100 allows sufficient opening for locating motor mount 71, motor cover 72, and motor 70. The vertical height of the hub 100 and perimeter members 102, along with levelers 106 fastened to the underside of the radial extending spokes 104 provide necessary vertical clearance required to mount drive means 20. A connection between the motor cover 72 and the hub 100 is provided by attachment plate 108 which is located on the underside of the motor cover 72 and the hub 100 and is fastened to each by fasteners 110. The weight of the carrier 10 and occupant is supported by base plate 38 being located on the top side of motor mount 71 and fastened thereto using fasteners 112. The motor mount 71 in turn rests on and distributes the weight onto the top of the hub 100.

Figure 15:
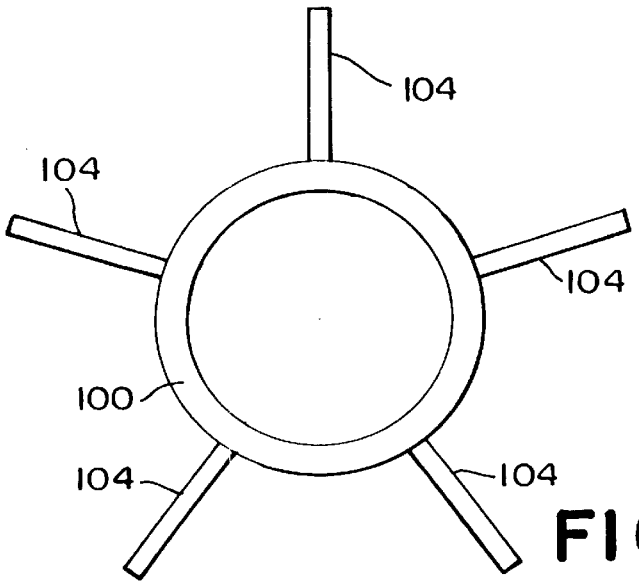
FIG. 15 is a top view of a radial spoked hub leg design.

In another embodiment shown in FIG. 15, the base legs 36 can also be replaced with all the components described in FIG. 13 and 14 pentagonal configuration with the exception of the perimeter structural members 102. This would be a radially spoked arrangement as illustrated.

Figure 16:
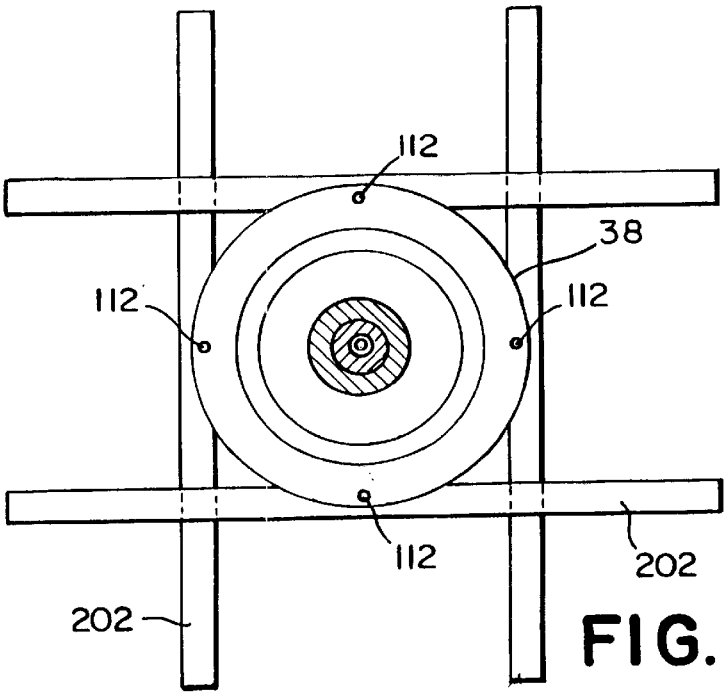
FIG. 16 is a top view of a grid member structure design.
Figure 17:
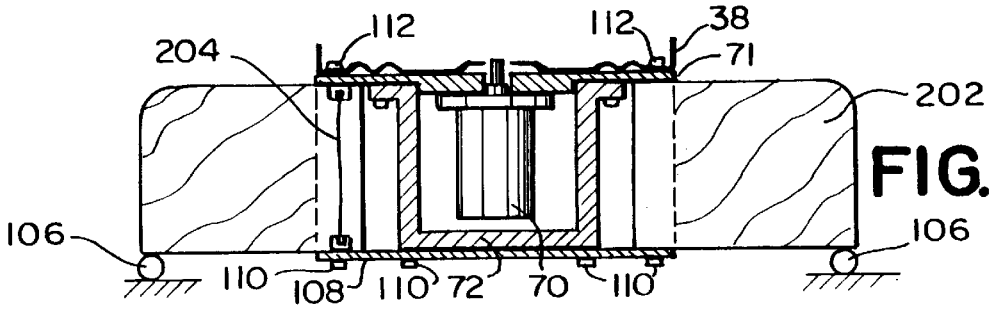
FIG. 17 is an enlarged cross-section of FIG. 16 showing attachment of the grid member structure to the motor housing.

In another embodiment shown in FIGS. 16 and 17, the pentagonal leg base design presented in FIGS. 13 and 14 can alternatively be replaced with a grid leg base arrangement illustrated using notched grid members (202) arranged in a grid fashion. The grid members are similarly notched at each intersection location so that when fitted together using fastener bolts 204 and nuts, a squared opening is achieved whereby the motor mount 71, motor cover 72, and motor 70 can be located. The motor cover 72 and grid members 202 are attached using attachment plate 108 and fasteners 110. The grid member are supported off the floor by levelers 106. The weight of the carrier 10 and occupant is supported by the base plate 38 being located on the top side of the motor mount 71 and fastened thereto using fasteners 112. The motor mount in turn rests on and distributes the weight onto the top of the squared box formed by the grid members 202.

Figure 18:
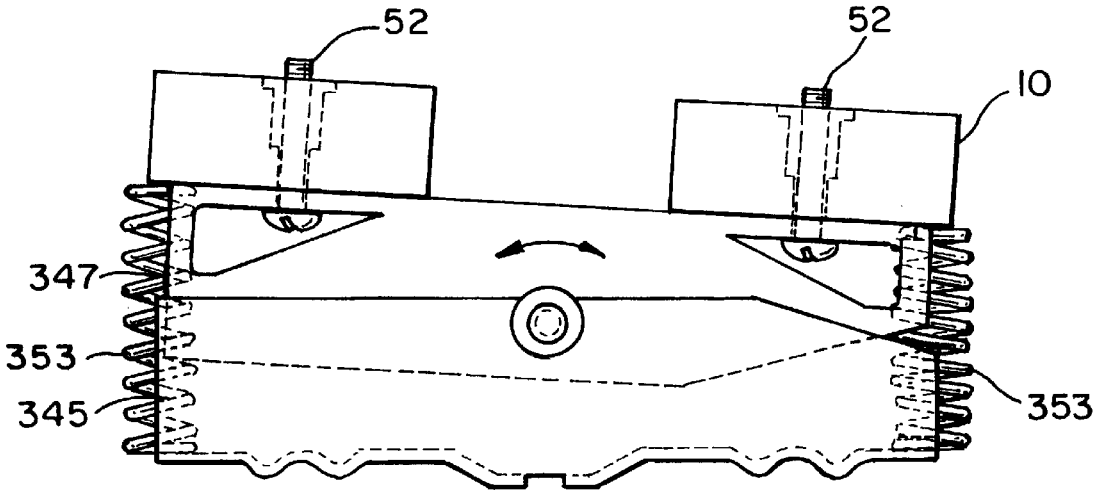
FIG. 18 is a side view of a rocker swivel carrier frame design.
Figure 19:
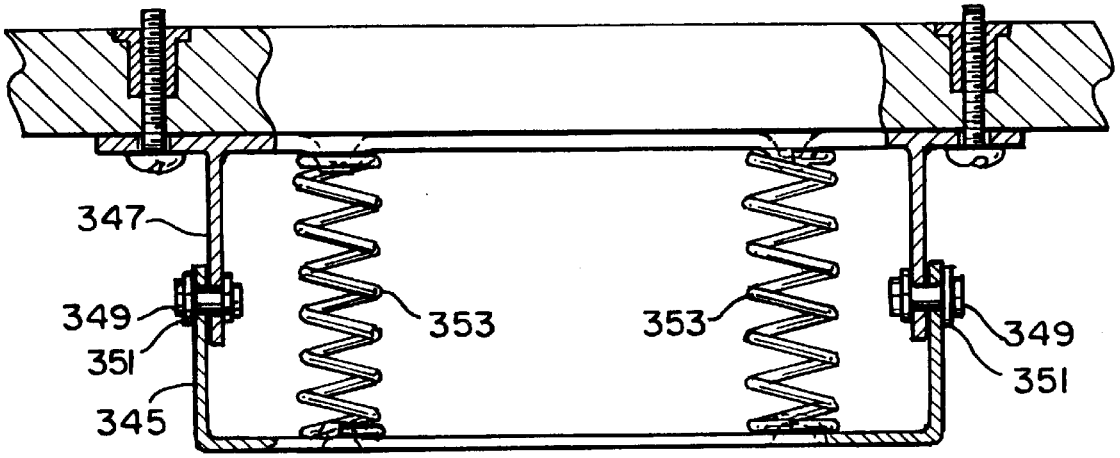
FIG. 19 is a front view of a rocker swivel carrier frame design.

In another embodiment shown in FIGS. 18 and 19, the carrier plate 45 may be replaced by rocker plates 345 and 347. The rocker plates are fastened together by pivoting pins 349 and washers 351. The lower rocker plate 347 has the same rotational features of the carrier pate 45 with the addition of rocker springs 353. The upper plate 347 is flanged at the corners to allow for attachment to the upper side of the carrier 10. The pivot pin design allows the top rocker plate to pivot in relation to the lower plate, thereby allowing the carrier to rock frontward and backward on the springs 353.

In the method of the present invention, a child pacification device is provided substantially as described above. In one embodiment, the child is placed in and secured to the carrier 12 of the child pacification device using either a safety harness 26 or an accessory such as a bassinet 230 or a subseat 128. The carrier of the device is then continuously rotated to provide a pacifying effect on the infant. Music and vibration may also be provided to the infant to provide further pacifying effect on the infant. The carrier may also accommodate multiple infants.

In a further embodiment, an infant pacification device capable of supporting an infant and an adult is provided substantially as described above. The adult sits or reclines in the carrier while safely holding the baby. The carrier is then continuously rotated to provide a pacifying effect on the infant. In this embodiment, the device may be used as adult comfort furniture when not in use as a child pacification device.

In a further embodiment, the carrier may be replaced with a playpen in which an infant may be safely maintained while the playpen is continuously rotated to provide a pacifying effect on the infant.

I claim:

1. Dual-purpose powered rotating infant pacification device comprising a carrier for supporting an infant, a carrier frame supporting the carrier, a base supporting the carrier frame, connecting means rotatably connecting the carrier frame to the base, drive means mounted on the base for rotating the carrier and transmission means for connecting the drive means and the carrier, the device being constructed and arranged to safely contain and continuously rotate the infant when the drive means is electrically engaged to provide a pacifying effect on the infant, and the device being constructed and arranged to safely support an adult and to have the carrier free to rotate manually when the drive means is electrically disengaged, the connecting means comprising a swivel bolt arrangement including a drive bolt, the drive bolt having a threaded end and a non-threaded head-end, the head-end having a hex-shaped socket formed therein, the drive bolt being fixed to the carrier frame at the threaded end of the drive bolt and rotatably connected to the base at the head end of the drive bolt.

2. The device recited in claim 1, the swivel bolt arrangement including a sleeve bearing with a flanged end located on the non-threaded head end of the drive bolt and radial slot cuts axially into the sleeved end, an insert bushing with a flanged end located over the sleeved portion of the sleeve bearing, the flanged end of the insert bushing contacting the flange portion of the sleeve bearing, and a washer and lock nut on the threaded end of the drive bolt for fastening the swivel bolt arrangement.

3. The device recited in claim 2, the drive bolt including a drive pin extending through the drive bolt transverse to the lengthwise axis of the drive bolt.

4. The device recited in claim 1, the connecting means further comprising a race and a plurality of ball bearings in the race, the race comprising a first downwardly facing annular groove in the carrier frame and a second opposed upwardly facing annular groove in the base, the ball bearings supporting the carrier frame above the base and permitting the carrier frame to rotate freely relative to the base.

5. The device recited in claim 1, the transmission means including a gearless, direct drive transmission comprising an output shaft on the drive means having a hex-shaped end portion, the hex-shaped end portion being inserted in the hex-shaped socket of the drive bolt.

6. Dual-purpose powered rotating infant pacification device comprising a carrier adapted to support an infant, the carrier comprising an adult size comfort chair having a horizontal cushion surrounded at least partially by cushioned side walls, a safety harness mounted on the carrier adapted to secure an infant on the carrier, a carrier frame supporting the carrier, the carrier frame comprising a carrier plate having an outer perimeter, a center aperture with an annular shoulder and an annular groove radially located intermediate the annular shoulder and the outer perimeter of the carrier plate, flange portions extending upwardly from the outer perimeter of the plate, and means for securing the flange portions to the carrier to secure the carrier to the carrier frame, the center aperture being circular disc-shaped, the annular shoulder having opposed square cut-outs in the annular shoulder contiguous with the circular disc-shaped center aperture along a common diameter of the aperture, a base supporting the carrier frame, the base comprising a circular base plate having an outer circumference, a center aperture with an annular shoulder and an annular groove radially located intermediate the annular shoulder and the outer circumference of the base plate, the base plate including a plurality of legs fixed to and extending from the base plate, the legs being constructed and arranged to elevate the base plate over a flat surface a distance sufficient to mount drive means underneath the base plate, connecting means rotatably connecting the carrier frame to the base, the connecting means comprising a swivel bolt arrangement including a drive bolt having a threaded end and having a non-threaded head end, the head end having a hex-shaped socket formed therein, the drive bolt being fixed to the carrier frame at the threaded end of the drive bolt and rotatably connected to the base at the head end of the drive bolt, the drive bolt including a lock pin extending through the drive bolt transverse to the lengthwise axis of the drive bolt, drive means mounted to the base for rotating the carrier, the drive means comprising an low-speed, high-torque, electric motor sized to spin the carrier when it is supporting one or two children, but which may be stalled by manually holding the carrier frame to prevent it from turning, and a gearless, direct drive transmission connecting the motor and the carrier, the transmission comprising a motor output shaft with a hex-shaped end, the hex-shaped end being inserted in and connected to the hex-shaped socket of the drive bolt, the carrier being constructed and arranged and adapted to safely contain and continuously rotate an infant when the motor is electrically engaged and adapted to provide a pacifying effect on an infant, the carrier also being constructed and arranged and adapted to safely support an adult and to be freely rotated manually when the motor is electrically disengaged without damaging the motor.

7. The device recited in claim 6, including an article from the group of a bassinet, a subseat, a tray, or a toy, or a combination thereof, secured to the carrier.

8. The device recited in claim 6, including a vibrator located underneath the horizontal cushion for providing further pacifying effect to an infant, and a music box mounted on the base for providing further pacifying effect to an infant.

9. The device recited in claim 6, the swivel bolt arrangement including a sleeve bearing with a flanged end located on the non-threaded head end of the drive bolt and radial slots cut axially into the sleeved end, an insert bushing with a flanged end located over the sleeved portion of the sleeve bearing, the flanged end of the insert bushing contacting the flange portion of the sleeve bearing, and a washer and lock nut on the threaded end of the drive bolt for fastening the swivel bolt arrangement.

10. The device recited in claim 6, the connecting means further comprising a race and a plurality of ball bearings in the race, the race comprising a downwardly facing first annular groove in the carrier frame and an opposed upwardly facing second annular groove in the base, the ball bearings supporting the carrier frame above the base and permitting the carrier frame to rotate freely relative to the base.

11. The device recited in claim 6, the base including a central hub and a plurality of geometrically extending interlocking legs, an anti-rotation locking means for locking the carrier in fixed position, and a rocker spring means to allow the carrier plate to rock relative to the base.

12. The device recited in claim 6, the electric motor having only enough torque to spin the carrier when only an infant is in the carrier.

13. The device recited in claim 6, the electric motor having enough torque to spin the carrier when an infant and an adult are in the carrier.

14. Dual-purpose powered rotating infant pacification device comprising a carrier adapted to support an infant, a carrier frame supporting the carrier, a base supporting the carrier frame, connecting means rotatably connecting the carrier frame to the base, drive means mounted on the base for rotating the carrier and transmission means for connecting the drive means and the carrier, said transmission means being constructed as a gearless, beltless direct drive connection, means to continuously rotate the carrier when the drive means is electrically engaged to provide a pacifying effect which is adapted to pacify an infant, and means adapted to have the carrier free to rotate manually when the drive means is electrically disengaged.

15. The device recited in claim 14, said transmission means, drive means, and connecting means all being collinear to a vertical axis of rotation.

16. The device recited in claim 15, said connecting means comprising a rotating shaft arrangement, said shaft having means to hold and capture the carrier frame to the base rotatably and means to directly couple two said drive means.

* * * * *